US005676567A

United States Patent [19]

Gluskoter et al.

[11] Patent Number: 5,676,567

[45] Date of Patent: Oct. 14, 1997

[54] INTERNAL/EXTERNAL MODULAR INTERFACE

[75] Inventors: Steven D. Gluskoter; Charles P. Zeller, both of Austin, Tex.

[73] Assignee: Dell USA, L.P., Round Rock, Tex.

[21] Appl. No.: 724,685

[22] Filed: Oct. 3, 1996

Related U.S. Application Data

[63] Continuation of Ser. No. 349,779, Dec. 6, 1994.

[51] Int. Cl.[6] ..... H01R 25/00

[52] U.S. Cl. ..... 439/638

[58] Field of Search ..... 439/638, 639, 439/502; 361/380, 390–399

[56] References Cited

U.S. PATENT DOCUMENTS 5,030,128 7/1991 Herron et al. ..... 439/639
5,123,092 6/1992 Buxton et al. ..... 395/250
5,139,439 8/1992 Shie ..... 439/638
5,227,953 7/1993 Lindberg et al. ..... 439/638
5,460,547 10/1995 Belt et al. ..... 439/638

*Primary Examiner*—Neil Abrams
*Assistant Examiner*—Brian J. Biggi
*Attorney, Agent, or Firm*—Skjerven, Morrill, MacPherson, Franklin & Friel L.L.P.; Stephen A. Terrile

[57] ABSTRACT

An interconnection system for electronic devices includes an internal master connecting terminal which is arranged to receive and mate with one of a plurality of available modular interfacing devices. The electronic device includes a system of internally arranged support and housing cavities which are graduated in size to house and support the modular interfacing devices and provide a uniform and contiguous output interface for connection to other electronic and peripheral devices. The modular interfacing devices are designed to accomodate the inclusion of various bus arrangements as well as additional components and circuitry, both active and passive.

10 Claims, 2 Drawing Sheets

INTERNAL/EXTERNAL MODULAR INTERFACE

This application is a continuation of application Ser. No. 08/349,779, filed Dec. 6, 1994.

FIELD OF THE INVENTION

The present invention relates generally to input-output interfaces and more particularly to an improved modular interface connection apparatus for electronic devices including portable personal computers.

BACKGROUND OF THE INVENTION

The rapid advancement of manufacturing capabilities for semiconductor devices has enabled an explosive growth in electronic devices and system capabilities being made available to consumers of electronic devices. This is especially apparent with regard to expansion of the personal computer industry. As semiconductor devices become smaller and smaller, more and more capabilities can be built into semiconductor chips and hence into personal computers and other electronic devices. Central Processing Unit (CPU) chips are assuming more control capabilities and peripheral functions are being engineered and developed at a rapid pace to take advantage of the increased CPU power and abilities. New functionality provides product differentiation as well as energizing an ever increasing market demand for the advances in functionality and technology.

The new and constantly developing product features arise in all technical areas, including, for example, communications, storage, graphics, and even entertainment in the forms of computer games. Each of these areas is developed in a different technological environment having differing pre-existing technological limitations and conventions which must be maintained for many reasons, including compatibility. As a result of this rapid development of peripheral capability with personal computers, there has evolved a plethora of protocols, conventions and connectivity requirements at the input-output interface of personal computers.

This development is most problematical in the portable computer market since, even though the number of connecting interfaces available on a portable computer adds to its potential total functionality and desirability, it also becomes a disadvantage by increasing the weight of the unit as well as its compactness. Each connecting interface or plug receptacle, has in the past necessarily included associated shielding and mechanical supporting structure for the various plugs to be received in order to insure solid mechanical and electrical connections to the connected peripheral devices. As additional peripheral functionality becomes available, in many cases a new connector or interface is required to be included in a "standard" personal computer (PC) in order to enable a user to have the capability to add the new functionality or peripheral device to his PC either at the time of purchase or at a future time when the need for such functionality becomes apparent or a new feature becomes available for use with a particular PC interface connector. Over time, the "standard" connectors or interfaces have become many, and since each has its own associated mechanical construction and support, the weight of the "standard" portable PC has increased.

Moreover, the compactness of portable computers has also been traded off for the desirability of the added functionality. Although portable computers, including laptops, notebooks, organizers, etc., are normally transported in a compact package, by the time the PC is connected for operational use, the arrangement includes interface connections with a compact disk (CD) and/or PCMCIA card and/or printer and/or modem/phone and/or speaker system, etc. Although all of these peripheral devices are normally not required by all users, still the connectors for such devices must be included in the PC input/output interface scheme to provide maximum connectivity to the user. Yet, the streamlined design and aesthetic impact of PCs has diminished as a result of the requirement to have all of the various connectors available on the PCs even though associated peripheral devices are not desired or needed by all consumers, at least at the time the PC is initially purchased.

Moreover, there is only a limited amount of linear spacing available for laptop computers and connector interfaces and the more congested this limited spacing becomes, the more likely it is that there could be a mechanical failure such as a plug becoming disconnected during operation, or even an electrical malfunction due to the extreme proximity of electrical connectors and even internal connections.

There is, therefore, a need for an improved apparatus and arrangement for making greater connectivity optionally available at the input-output connection interface of portable computers and other electronic devices which may benefit from increased connectivity capability to new and peripherally available functionality which may be found in related electronic equipment, while at the same time, maintaining or even reducing the overall weight of the PC, and providing a system by which the overall compactness of the PC is made to be selectively variable and variably dependent upon the application of the PC and the personal choice of the user relative to the selection of peripheral connectors.

DISCLOSURE OF THE INVENTION

Accordingly, it is a feature of the present invention to provide an improved input-output interface apparatus which allows connection to a greater number of peripheral devices while simultaneously providing the user with a choice of available input-output connectors depending upon the user's particular application.

It is another feature of the present invention to provide an input-output interface as stated above which further allows for future changes in the user's input-output interface and connector requirements.

It is still another feature of the present invention to provide an interface which is modular in nature to provide for easy adaptation to differing specific application options as well as future connection options.

It is yet another feature of the present invention to provide an input-output interface apparatus which is lightweight, sturdy and provides a wide selection of specific standard interface arrangements thus enabling a greater application of the interface apparatus to a plurality of electronic devices normally requiring electrical connections to other electronic devices.

It is still another feature of the present invention to provide an improved modular connector which allows for provisionally including added functionality within the connector itself thereby even further enhancing the adaptability of the improved interface.

These and other features and objects are provided by the disclosed interconnecting modular devices which are capable of being interconnected among various electronic devices in a single interface apparatus or system thereby allowing a user to customize the connectivity of any particular electronic device such as a PC, within any one of many possible system arrangements for various user applications. The connector system includes a master docking bus preferably within an electronic device such as a notebook personal computer (PC). The master docking bus is designed to provide access to substantially all major buses and signal connection points which may need to be interfaced with peripheral device connectors or other detached or external electronic equipment. The master docking bus is arranged to receive one of several possible master docking connectors, each of which is arranged for connection with one or more of a variety of possible peripheral connectors. The modular connectors are designed so that the user needs to have only those output connectors which the user is actively using at any particular time and not other unused connectors, while, at the same time, having the capability to quickly and easily add different connector interfaces for a different set of output or other peripheral devices if convenient or required in a different PC application environment.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION

Figure 1:
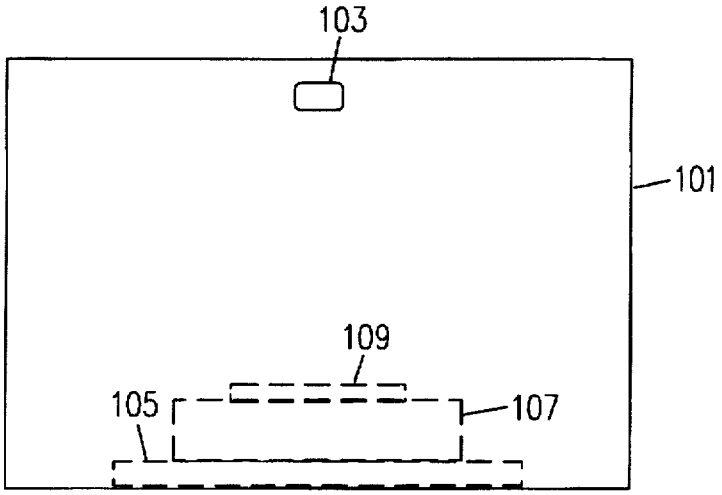
FIG. 1 is a diagram illustrating a notebook personal computer including one embodiment of an input-output interface receptacle for receiving a modular connector in accordance with the present invention.

Referring now to FIG. 1 in detail, there is shown a notebook sized personal computer (PC) 101. For purposes of illustrating the principles of the present invention, the following explanation is given with respect to a portable personal computer although it is understood that the connecting method and apparatus disclosed also applies to other electronic devices which include input-output interfaces for connection to peripheral electronic devices or other connections which are necessary for the intended operation or enhance the operation of the connecting device, and where it is desirable to maximize the connectivity and minimize the clutter and weight of the interface itself.

The PC 101 is shown in the present example with a typical latching device 103 at the opening end of the PC 101. The hinged side of the PC 101 includes a series of recessed cavities 105, 107 and 109 for receiving variously sized modular connectors in accordance with the present invention. The inside portion of the receiving cavity 109 is implemented with an electrical interconnecting and electrically mating apparatus to receive and electrically connect with a variety of modular interconnecting devices from external peripheral electronic devices. The exact type of electrical connection hardware may be one of many connecting schemes and devices which are very well known in the art and available in the market, the details of which are not shown here in order not to unnecessarily complicate or limit the disclosure.

Figure 2:
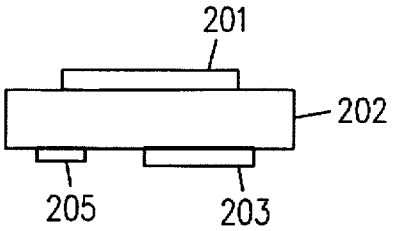
FIG. 2 is an illustration showing one exemplary modular input-output interface.

Referring to FIG. 2, there is illustrated a modular plug for use with the modular receptacle shown in FIG. 1. The plug or connector shown in FIG. 2 includes a PC connecting jack 201, which is arranged to fit within the cavity 109 of the PC 101 and make electrical connection therewith. The modular plug of FIG. 2 also includes a body section 202 as well as two output connecting interfaces 203 and 205. The connector 203, for example could be a so called "parallel" connector and the smaller connector 205 could be a "serial" connector which are commonly used with PC systems. The parallel connector 203 may be arranged to be connected with a printer to be used with the PC 101 and the serial connector interface 205 may be used to connect with an external mouse. The connectors 203 and 205 are considered to be a parallel connector and a serial connector in the present example but could be any two connecting interfaces which are now considered standard interfaces, or any future connection standard. For example, connectors or interfaces which are implemented with PC systems include parallel and serial connectors as noted above, as well as mouse connectors, video, SCSI, Ethernet, Token Ring, modem, audio, microphone and infrared.

Figure 3:
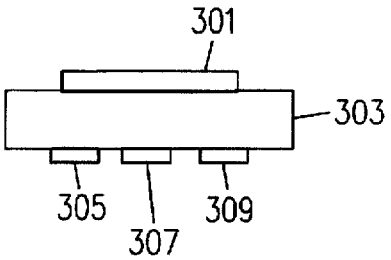
FIG. 3 is an illustration of another exemplary modular interface which may be used with the personal computer shown in FIG. 1.

In FIG. 3, there is shown another exemplary embodiment of a modular connector in accordance with the present invention. The connector includes a base interface 301 which is arranged for connection within the cavity 109 of a PC. In the example shown in FIG. 3, the modular connector includes a main body 303 and three output interfaces 305, 307 and 309. The three output interfaces may be, for example, serial interfaces which could be used to connect the PC 101 to a mouse, and other peripheral units.

It should be noted that because of the mounting recesses 105, 107 and 109 in the PC 101, there need be only minimal additional mechanical support if any, since the modular connectors disclosed herein, are designed to be supported by the housing structure which defines the connector-enclosing cavities themselves. Moreover, the recessed nature of the present design also provides a streamlined unit without being encumbered by having a large number of unused connectors taking up lineal space along the sides of a PC or a large number of peripheral connectors awkwardly connected to various devices and hanging off the edges of the Pc and creating substantial risk of an disconnect failure while running a critical PC application. The provision of the modular interfacing construction as disclosed herein significantly ameliorates these problems.

Figure 4:
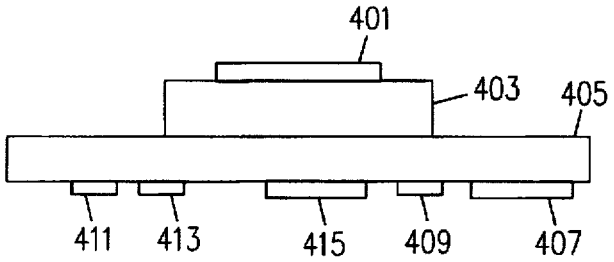
FIG. 4 is an illustration of yet another modular jack which may be utilized in accordance with the teachings of the present invention.

In FIG. 4, another exemplary modular connector interface is shown which includes a master connector interface 401 designed to make electrical connections with the PC 101 within the cavity 109. In the FIG. 4 example, there are shown first and second body sections 403 and 405. The second body member provides a plurality of output interfaces. In the example, there are two serial connectors 411 and 413 adjacent to a parallel connector 415. Next to the parallel connector 415 is another serial connector 409 and adjacent thereto is another parallel connector 407. It should be noted that the connecting interfaces are described herein as "serial" or "parallel" to refer to such interfaces that are well known in the industry. The present invention, however, also applies to other standard and even future standard connectors and interfaces to the extent that such may be implemented in accordance with the modular constructions as herein disclosed.

The modular connector as shown in FIG. 4 for example may be utilized in a more extensive application than the connector shown in FIG. 3 could enable. However, the user requiring only the FIG. 3 connector for a particular application need not carry around unused connectors as would be available on a more extensive interface such as that shown in FIG. 4. With the added plug capability of the device shown in FIG. 4, there is necessarily more bulk and weight, However, in accordance with the teachings of the present invention, any added connection capability is easily accomodated by the construction of the modular interfacing arrangement. The body member 403 is designed to mechanically fit within the cavity 107 of the PC 101. Additionally, the extended body member 405 is designed to fit within the cavity 105. If additional support is required for a more extensive interface, additional modular body members may be added to accomodate and mechanically support larger and more extensive connectors.

Moreover, the larger modular compartments such as the second body member 405 in FIG. 4, are also designed to accomodate various bus and internal connection arrangements as well as passive or active circuitry and circuit components. This capability adds substantially to the gamut of design options for electronic equipment designers. With the ever decreasing size of semiconductor chips and associated circuitry, significant systems could be implemented as options and wholly included within variously sized interconnecting modular plug interfaces as shown herein. The system is inherently designed to automatically provide mechanical and electrical support for such expanded and future systems. Future systems accommodating future standards advanced capabilities can be implemented through the substitution of a more extensive interface, including additional electronic circuitry, rather than requiring the purchase of an entirely new PC or electronic system.

Figure 5:
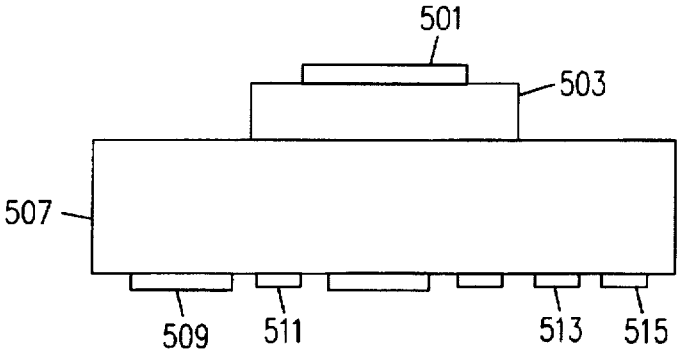
FIG. 5 is an expanded version of a modular connector which may be utilized in interconnecting electronic devices in accordance with the teachings of the present invention.

In FIG. 5, another modular device is shown which includes a master electrical interface 501 arranged for connection to a master interface within a master connector cavity 109. The FIG. 5 connector includes a first body member 503 to mate with the cavity 107 and an extended body member or housing 507. The member 507 is shown in FIG. 5 to be partially or wholly inserted into the cavity 105, but can also be designed to be inserted within the cavity 107, or to abut the entire length of the connector side of the PC 101 with only the members 501 and 503 being within the PC 101. The exact arrangement is very flexible and adapts readily to changing standards and interconnection needs of the industry. The modular connector shown in FIG. 5 also includes a plurality of output interfaces of various sizes 509, 511, 513 and 515. As hereinbefore noted, the modular interconnecting interfaces shown herein are designed to accomodate added bus structures and connection transfers as well as additional components and circuitry as may be appropriate for many systems within which the present invention may be implemented.

Figure 6:
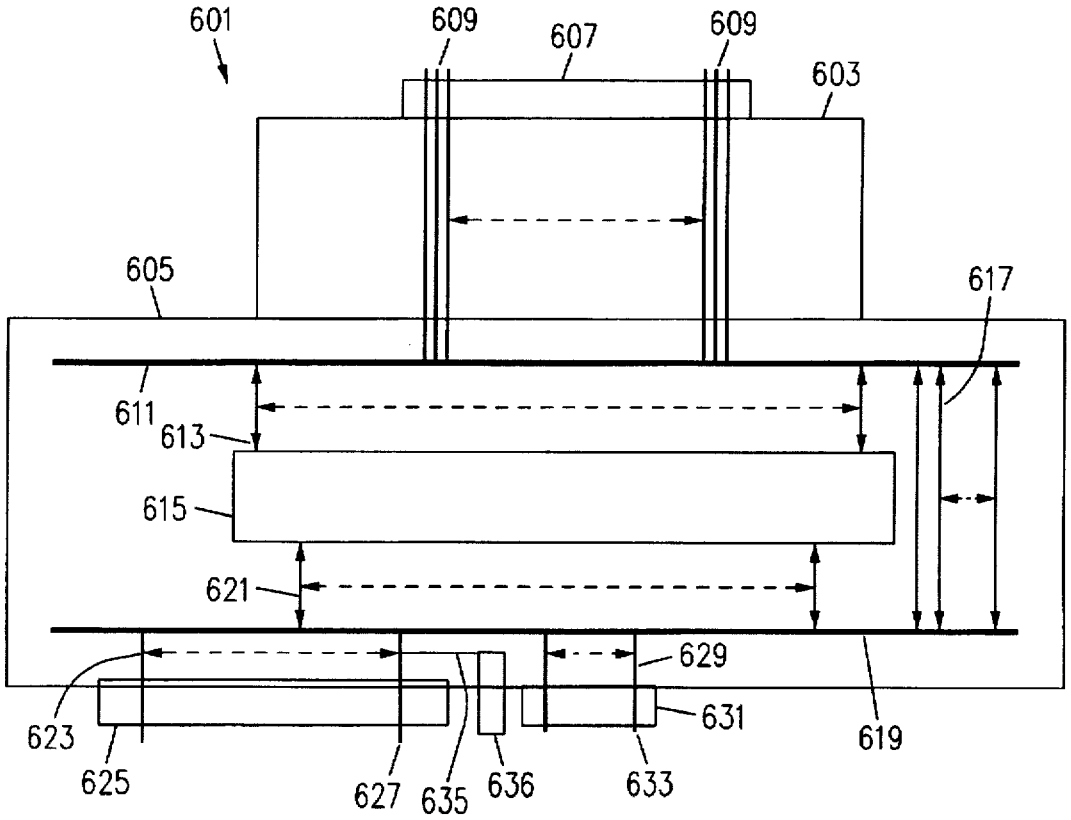
FIG. 6 is an illustration of one embodiment of the present invention showing one possible arrangement of components within an exemplary connector device.

In FIG. 6, a modular connector 601 is shown. The connector 601 includes a first body member 603 and a second body member 605 connected thereto. The connector 601 is designed to fit within the cavities shown in FIG. 1 in the connector end of the PC 101. The connector 601 includes an electrical interface 607 which in the present example, includes terminals 609 generally extending from the interface 607 and arranged for connection to a master connector within the cavity 109 of the PC 101. Signal lines run from the terminals 609 to a first signal bus 611 within the connector 601. A plurality of signal lines 613 are connected from the bus 611 to a circuit device 615. The device 615 may, for example, be a semiconductor chip or other circuitry or components, mounted within the connector 601 as shown. A second plurality of signal lines 617 connects the bus 611 to a second bus 619 which in the present example serves as a connector peripheral bus. Another group of signal lines 621 connects the circuit 615 to the connector peripheral bus 619. Predetermined signal lines 623 are connected from the peripheral or second bus 619 through an output connector interface 625 to peripheral connector terminals 627. In the present example, a second set of signal lines are connected from the second bus 619 through connectors 629 to a second peripheral plug 631 and made available at peripheral terminals 633. In the example of FIG. 6, the connector 625 may be a parallel connector for a printer and the connector 631 may be a serial connector arranged for connection to a high resolution video monitor or other application.

The connector 601 shown in FIG. 6 is deemed to be capable of being applied to a large number of applications and not limited to computer related systems exclusively. Connector 601 is designed to accomodate active and passive circuitry included therein as well as even power supplies and batteries. The modular connector and connector system disclosed herein could also, for example, be implemented in a communication system where a communication device is to be used in another country where the communication protocols are different. In that case, a user would be able to bring an international or country specific "active connector" to be able to plug into foreign communication system. Certain signals which would not require modification would pass through connectors or signal lines 617 while those signal lines that would require processing would be applied to the circuit means 615.

The circuit device 615 may also include Read Only Memory (ROM) devices and other memory devices which may also be required or desirable for a foreign application. The circuitry within the connector 601 could also be matched with the mechanical outputs 625 and 631 for compatibility with various systems and signal protocols. Circuitry 635 could also be added to aid in trouble shooting system defects. For example, light pipes or other visible or audible signals or other indicia 636 could be implemented to indicate the presence or absence of a signal or signals on any of the signal lines or terminals within the connector 601 or at one or more of its interfaces.

The modular connector 601 could also be used to provide a new output for an application that was not required when the PC 101, for example, was initially purchased, or even to modify existing circuitry within the electronic device such as the PC 101. Instead of requiring a purchaser to acquire an entirely new replacement electronic device to obtain the benefits of a newly added function, it would be possible for a user to merely acquire a new modular connector including the new electronics within the circuit device, for example device 615. The user would need only to purchase a new connector rather than an entirely new computer to obtain the benefits of many added features as they are newly introduced to the market.

The modular interfacing system disclosed herein allows a notebook PC user for example, to select and swap the appropriate Input-Output (I/O) interface module to service the user's particular current needs without burdening the system with unnecessary connectivity and unused and open plug connectors. The present invention does not burden the size, weight and cost of every notebook computer, for example, with all of the industry standard I/O interfaces and allows users to choose to purchase only what they require for their application thereby minimizing the weight and bulkiness of their particular system. The notebook computer in the present example, has one accessible but internal connector which is designed to dock or mate at a master interface with a corresponding modular interface to provide connections to external devices. The user is thus given a selection of optional modules that will fit inside the notebook and act as a pass through I/O. The modules can be designed with various I/O combinations depending upon the user's particular application, such as video/parallel, mouse/keyboard, serial/parallel, serial/serial, etc. The internal docking connector can also be used to expand the connectivity of the notebook PC externally. This allows the manufacturer to save size, weight and cost in the production of the unit and also allows the user to custom-confugure his notebook to suit his particular application, and also allows for the elimination of external connection appendages that can easily disconnect during operation, or be lost or broken.

Thus, there has been provided, in accordance with the present invention, a modular interfacing construction and system for interconnecting electronic devices which maximizes system connectivity and flexibility while minimizing the size and weight of the devices. The apparatus of the present invention has been described in connection with the preferred embodiment as disclosed herein. Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention as defined by the following claims.

What is claimed is:

1. A computer system selectively operable for providing output signals at an output interface for application to one or more external devices, each external device having an individual interface connection arrangement for receiving selected ones of said output signals, said computer system comprising:

a output terminal arrangement including output terminals for substantially all of said output signals; and a connector housing arranged to receive and mate with input terminal sections of a plurality of variously sized and configured connector devices, each of the plurality of variously sized and configured connecting device including a body section and an output terminal section, the connector housing defining a plurality of contiguous chambers for receiving and supporting the body section of correspondingly shaped connecting devices, the plurality of contiguous chambers becoming progressively smaller as the plurality of contiguous chambers extend into the computer system.

2. The personal computer as set forth in claim 1 wherein said chambers are substantially rectangular in cross section.

3. A computer system, the computer system providing output signals at an output interface, said computer system comprising:

a output terminal arrangement including output terminals for substantially all of said output signals;

a connector device including an input terminal section for receiving selected ones of the output signals, a body section and an output terminal section;

a connector housing arranged to receive and mate with the input terminal sections of a plurality of variously sized and configured connector devices including the connector device; the connector housing defining a plurality of contiguous chambers for receiving and supporting the body section of correspondingly shaped connecting devices, the plurality of contiguous chambers becoming progressively smaller as the plurality of contiguous chambers extend into the computer system, the output terminal arrangement being located within an innermost chamber of the plurality of contiguous chambers.

4. The computer system of claim 3 wherein the body section of the connector device includes a plurality of adjacent rectangular sections of varying cross sectional dimensions.

5. The computer system of claim 3 wherein the connector device includes a bus arrangement within the body section for interconnecting the input terminal section with the output terminal section.

6. The computer system of claim 3 wherein the connector device includes electrical components connected within the body section between the input terminal section and the output terminal section.

7. The computer system of claim 3 wherein the connector device includes electronic circuitry connected between the input terminal section and the output terminal section.

8. The computer system of claim 3 wherein the connector device includes a perceptible indicia device connected to one of input and output terminal sections, the perceptible indicia device being arranged to provide a perceptible indication of the presence or absence of a signal on a terminal of the connector device.

9. The computer system of claim 8 wherein the perceptible indicia device provides an audio indicium.

10. The computer system of claim 8 wherein the perceptible indicia device provides a visual indicium.

* * * * *